US008703047B2

(12) United States Patent
Hirata et al.

(10) Patent No.: US 8,703,047 B2
(45) Date of Patent: Apr. 22, 2014

(54) CLOTHING ORNAMENT MADE FROM A HIGH-MN AUSTENITIC STAINLESS STEEL

(75) Inventors: Shigeru Hirata, Kanagawa (JP); Yuji Ikegami, Kanagawa (JP); Kazuhiro Yamakawa, Kanagawa (JP)

(73) Assignee: Nippon Yakin Kogyo Co., Ltd., Tokyo (JP)

( * ) Notice: Subject to any disclaimer, the term of this patent is extended or adjusted under 35 U.S.C. 154(b) by 105 days.

(21) Appl. No.: 13/146,105

(22) PCT Filed: Feb. 26, 2010

(86) PCT No.: PCT/JP2010/053599

§ 371 (c)(1),
(2), (4) Date: Jul. 25, 2011

(87) PCT Pub. No.: WO2010/098506

PCT Pub. Date: Sep. 2, 2010

(65) Prior Publication Data

US 2011/0286879 A1 Nov. 24, 2011

(30) Foreign Application Priority Data

Feb. 27, 2009 (JP) ..... 2009-045492

(51) Int. Cl.
*C22C 38/58* (2006.01)
*C22C 38/52* (2006.01)

(52) U.S. Cl.
USPC ..... 420/58; 420/57; 148/327; 148/329

(58) Field of Classification Search
CPC ..... C22C 38/58
USPC ..... 420/44–47, 56–58, 73, 74; 148/327, 148/329
See application file for complete search history.

(56) References Cited

U.S. PATENT DOCUMENTS

2003/0177617 A1 9/2003 Kita et al.

FOREIGN PATENT DOCUMENTS

| | | |
|---|---|---|
| JP | 50-33916 | 4/1975 |
| JP | 51-47516 | 4/1976 |
| JP | 54-106015 | 8/1979 |
| JP | 61-207552 | 9/1986 |
| JP | 08-269639 | 10/1996 |
| JP | 2003-277890 | 10/2003 |
| JP | 2005-154890 | 6/2005 |
| JP | 2006-111932 | 4/2006 |

OTHER PUBLICATIONS

Key to Steel, Verlag Stahlschlussel Wegst Kg, W.Germany, 1974.*

(Continued)

*Primary Examiner* — Deborah Yee
(74) *Attorney, Agent, or Firm* — Greenblum & Bernstein, P.L.C.

(57) ABSTRACT

As a stainless steel for a metal part for clothing ornament capable of working into a complicated form part and having such nonmagnetic properties that the worked part can cope with the detection through needle detecting device is provided a high-Mn austenitic stainless steel having a chemical composition comprising C: 0.02-0.12 mass %, Si: 0.05-1.5 mass %, Mn: 10.0-22.0 mass %, S: not more than 0.03 mass %, Ni: 4.0-12.0 mass %, Cr: 14.0-25.0 mass % and N: 0.07-0.17 mass %, provided that these components are contained so that δ cal (mass %) represented by the following equation (1) is not more than 5.5 mass %:

$$\delta\ \text{cal (mass \%)}=(\text{Cr}+0.48\text{Si}+1.21\text{Mo}+2.2(\text{V}+\text{Ti})+0.15\text{Nb})-(\text{Ni}+0.47\text{Cu}+0.11\text{Mn}-0.0101\text{Mn}^2+26.4\text{C}+20.1\text{N})-4.7 \quad (1)$$

and having a magnetic permeability of not more than 1.003 under a magnetic field of 200 kA/m.

16 Claims, 3 Drawing Sheets

(56) References Cited

OTHER PUBLICATIONS

English-hand translation of Japanese patent 51-47516, Masakuni Fujikura, et al., Apr. 23, 1976.*

International Preliminary Report on Patentability for PCT/JP2010/053599, mailed Sep. 13, 2011.

Search report from International Application No. PCT/JP2010/053599, mail date is Jun. 15, 2010.

* cited by examiner

CLOTHING ORNAMENT MADE FROM A HIGH-MN AUSTENITIC STAINLESS STEEL

TECHNICAL FIELD

This invention relates to a high-Mn austenitic stainless steel which is easy in the working to a complicated form of clothing parts such as hooks, buttons, pant hooks and eyes, spring hooks and so on and has nonmagnetic properties causing no false detection even in an inspection for detecting fractured needles through a needle detecting device as well as metal parts for clothing ornament made from such stainless steels.

BACKGROUND ART

Metal parts for clothing ornament such as hooks, buttons, pant hooks and eyes, spring hooks and so on are manufactured through complicated working steps such as pressing, coining and the like because designing properties (designability and fashionability) are required to be provided for the purpose of distinguishing over other products in addition to the functionality. Therefore, metal materials as a raw material for these parts are required to have a plastic workability durable to severer working, and soft materials such as brass, aluminum alloys and the like are frequently used since early times. Also, joining between mutual parts or fixing to the cloth is generally conducted by "caulking" through pressing, from which it is also required to use a soft material.

Recently, severer inspections are carried out by adopting a needle detecting device for judging whether or not a fractured needle remains in a product during sewing through presence or absence of magnetic property from a viewpoint of attaching importance to safety. Since these inspections are conducted in final products, they are carried out after the attachment of metal parts such as hooks, buttons, pant hooks and eyes and so on. In this connection, metal parts made from the aforementioned brass, aluminum alloy and the like are small in the magnetic property and are not falsely detected as a fractured needle, so that they do not particularly pose a problem for the inspection.

In the metal parts made from the brass, aluminum alloy and the like, however, there may be caused an inconvenience that discoloration is brought by chemicals such as dyestuff or the like remaining in a cloth on the way of transferring at a vinyl-packed state. Consequently, it is examined to change them into a metallic material causing no discoloration, for example, stainless steel or the like. In JP-A-H08-269639, for example, there is a proposal that Ni—Cr based nonmagnetic stainless steel is applied to metal parts for clothing ornament requiring spring properties while utilizing high strength as a characteristic of the stainless steel as compared with the brass or aluminum alloy.

However, the Ni—Cr based nonmagnetic stainless steel of JP-A-H08-269639 has a magnetic permeability of about 1.005 though it is said to be nonmagnetic, so that the nonmagnetic property is insufficient, and when it is applied to pant hooks and eyes or socket having a large weight, false detection may be caused by the detecting device. Also, such a stainless steel can not be said to be good in the plastic workability because the strength is enhanced by cold rolling and further the steel is hard even after the solid solution heat treatment for imparting the spring property. As regards the caulking, there is a problem that it is difficult to fix to the cloth by a common process. In order to use the stainless steel instead of the brass or aluminum alloy, therefore, it is required to further improve the nonmagnetic properties and the plastic workability (softening).

In JP-A-2005-154890 are proposed Mn—Cr based austenitic stainless steels for press forming such as deep drawing or the like as a nonmagnetic stainless steel improving the workability. In this stainless steel, however, the chemical composition, stability of austenite phase, production indications such as stacking fault energy and the like are designed to be controlled so as to maintain the nonmagnetic property even after the plastic working, but the magnetic permeability after the resulting material is subjected to cold rolling at 60% is about 1.01-1.05, so that the nonmagnetic property is insufficient.

DISCLOSURE OF THE INVENTION

Problems to be Solved by the Invention

As mentioned above, soft and nonmagnetic stainless steels, which are capable of sufficiently working to soft and complicated parts for clothing and do not cause false operation in the needle detecting device, are not yet existent at the present time. Therefore, it is strongly demanded to develop stainless steels having an excellent plastic workability capable of conducting high-designing and complicated plastic working and excellent nonmagnetic properties causing no false detection through the needle detecting device even when being used in metal parts for clothing ornament having a large weight.

It is, therefore, an object of the invention to solve the aforementioned problems of the conventional techniques and to provide stainless steels being capable of working to parts of complicated forms for clothing ornament such as buttons, pant hooks and eyes, sockets and so on and having excellent nonmagnetic properties capable of sufficiently coping with severer inspections of these worked products through the needle detecting device.

Means for Solving Problems

The inventors have made extensive examinations on the influence of steel composition upon magnetic permeability and hardness in order to solve the above problems. As a result, it has been found that Mn—Cr based stainless steels have a possibility that a small magnetic permeability is obtained, which is never attained in the conventional Ni—Cr based stainless steels. This is based on the fact that although Mn and N are elements effective for reducing the magnetic permeability, if a great amount of Mn is added, an amount of N solid-soluted can be increased. Now, the inventors have further examined the influence of steel composition upon the magnetic permeability and hardness in Mn—Cr based stainless steel containing a greater amount of N solid-soluted in detail. Particularly, the examinations are conducted considering the balance of the components as a whole because the metallic structure and its stability are largely affected on the magnetic permeability.

Namely, in order to obtain good nonmagnetic properties, it is necessary that δ-ferrite phase produced during the solidification and having a magnetic property does not remain in a product plate. Also, it is necessary that even if a product plate of single austenitic phase having no δ-ferrite phase is obtained, martensite phase having a magnetic property is not induced when it is worked to parts. Furthermore, it is necessary to make the magnetic permeability small by taking the influence of component elements after the prevention of forming these two phases having the magnetic property. In addition to these features, the influence of steel components upon the hardness is examined for imparting the good plastic workability but also the examination is conducted on the productivity for producing more cheaply, and as a result, the invention has been accomplished.

The invention is a high-Mn austenitic stainless steel having a chemical composition comprising C: 0.02-0.12 mass %, Si: 0.05-1.5 mass %, Mn: 10.0-22.0 mass %, S: not more than 0.03 mass %, Ni: 4.0-12.0 mass %, Cr: 14.0-25.0 mass %, N: 0.07-0.17 mass % and the balance being Fe and inevitable impurities, provided that these components are contained so that δ cal (mass %) represented by the following equation (1) is not more than 5.5 mass %:

$$\delta\ \text{cal (mass \%)}=(\text{Cr}+0.48\text{Si}+1.21\text{Mo}+2.2(\text{V}+\text{Ti})+0.15\text{Nb})-(\text{Ni}+0.47\text{Cu}+0.11\text{Mn}-0.0101\text{Mn}^2+26.4\text{C}+20.1\text{N})-4.7 \quad (1)$$

wherein each element symbol in the equation is a content of the respective element (mass %), and having a magnetic permeability of not more than 1.003 under a magnetic field of 200 kA/m.

The high-Mn austenitic stainless steel according to the invention is characterized by further containing one or more elements selected from Mo: 0.03-2.0 mass %, Cu: 0.03-3.0 mass %, V: 0.02-1.0 mass %, Ti: 0.02-1.0 mass % and Nb: 0.02-1.0 mass % in addition to the above chemical composition.

Also, the high-Mn austenitic stainless steel according to the invention is characterized by further containing one or more elements selected from B: 0.0005-0.01 mass %, Ca: 0.0005-0.01 mass %, REM: 0.0005-0.01 mass % and Mg: 0.0005-0.01 mass % in addition to the above chemical composition.

Furthermore, the high-Mn austenitic stainless steel according to the invention is characterized in that the above components are contained so that Ni equivalent represented by the following equation (2) is not less than 26 mass %:

$$\text{Ni equivalent (mass \%)}=15\text{C}+0.33\text{Si}+0.71\text{Mn}+\text{Ni}+0.44\text{Cr}+0.60\text{Mo}+0.51\text{Cu}+21\text{N}+1.2\text{V}+0.8\text{Ti}+1.1\text{Nb} \quad (2)$$

wherein each element symbol in the equation is a content of the respective element (mass %).

Moreover, the high-Mn austenitic stainless steel according to the invention is characterized in that the above components are contained so that Hv value represented by the following equation (3) is not more than 200:

$$\text{Hv value}=87\text{C}+2\text{Si}-1.2\text{Mn}-6.7\text{Ni}+2.7\text{Cr}+3.2\text{Mo}-2.6\text{Cu}+690\text{N}+18\text{V}+20\text{Ti}+24\text{Nb}+88 \quad (3)$$

wherein each element symbol in the equation is a content of the respective element (mass %).

The invention is also a metal part for clothing ornament made from a high-Mn austenitic stainless steel as described in any one of the above items.

Effect of the Invention

According to the invention, there can be provided stainless steels having not only an excellent plastic workability but also excellent nonmagnetic properties. This stainless steel is easy in the working to parts of complicated form and does not cause false detection even in the inspection through a needle detecting device, so that it can be preferably used as a starting material for metal parts used in clothing ornaments such as hooks, buttons, pant hooks and eyes, spring hooks and so on.

EMBODIMENTS OF THE INVENTION

How to develop the invention and basic technical idea will be first explained below.

(1) Prevention of δ-Ferrite Phase Remaining on Product

When an austenitic stainless steel is shaped into a slab by a continuous casting method or the like, it is common that the solidification structure is a mixed structure of austenite phase and several vol % of δ-ferrite phase. Since the δ-ferrite phase has an influence on the productivity and magnetic properties of the product, a relationship between chemical composition and δ-ferrite phase ratio is examined on a large number of Ni—Cr based austenitic stainless steels exemplified by SUS 304, and also some predictive formulae are proposed. On the contrary, Mn—Cr based austenitic stainless steel is scarcely examined and there is only a technical report by Hull (Welding Journal, 58, No. 5 (1973), pp 193-203).

The inventors have measured a ratio of δ-ferrite phase produced in slabs of Mn—Cr based austenitic stainless steel with a variety of chemical composition manufactured through a continuous casting process by means of a ferrite meter and compared the measured value with the above Hull's equation to examine a reasonability of the Hull's equation with respect to a relationship between the chemical composition of the slab and δ-ferrite phase ratio but also attempted a derivation of an influence coefficient of other elements not described in the Hull's equation. Moreover, a major reason in the difference of influence coefficient between the Hull's equation and the following equation (1) according to the invention is considered to be based on a difference of cooling rate:

$$\delta\ \text{cal (mass \%)}=(\text{Cr}+0.48\text{Si}+1.21\text{Mo}+2.2(\text{V}+\text{Ti})+0.15\text{Nb})-(\text{Ni}+0.47\text{Cu}+0.11\text{Mn}-0.0101\text{Mn}^2+26.4\text{C}+20.1\text{N})-4.7 \quad (1)$$

wherein each elemental symbol in the above equation represents a content of respective element (mass %).

Figure 1:
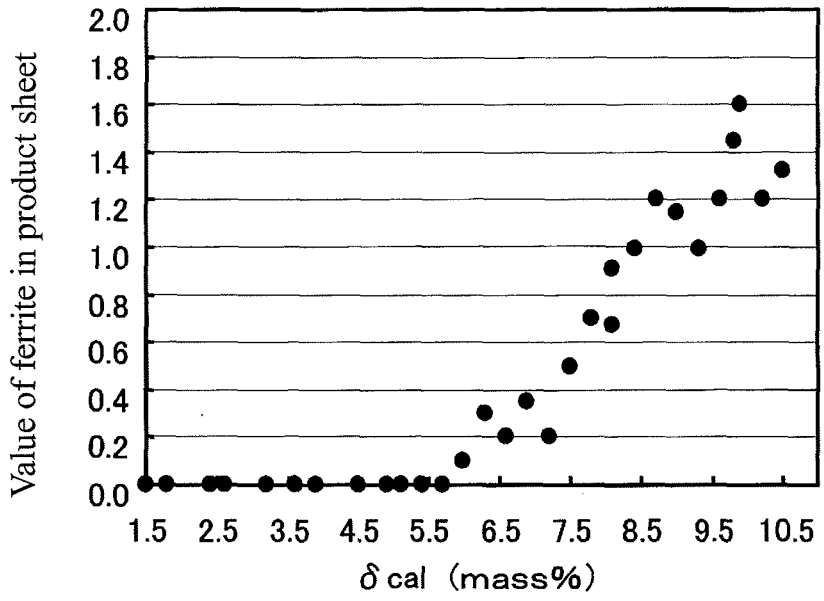
FIG. 1 is a graph showing an influence of a value of δ cal upon an amount of δ-ferrite phase remaining in a product plate.

The inventors have further investigated a relation between the value of δ cal and δ-ferrite ratio remaining on a product sheet (cold rolled sheet) of 2 mm in thickness. As a result, it is clear that as shown in FIG. 1, when the value of δ cal exceeds 5.5 mass %, δ-ferrite phase remains on a steel sheet after the hot rolling and this residual δ-ferrite phase is retained without disappearing even after the cold rolling to considerably deteriorate the nonmagnetic properties. In the invention, therefore, the components are designed so that the value of δ cal in the equation (1) is not more than 5.5 mass %. Moreover, if elements described in the equation (1) are not included, they are calculated to be zero (0) (which is similar in the following equations (2) and (3)).

(2) Prevention of Forming Strain-Induced Martensite Phase

In the austenitic stainless steels, it is known that martensite phase having magnetic property is produced even by cold working. With respect to a relation between chemical composition and stability of austenite phase in Ni—Cr based stainless steel, many studies were made, and relations called as Ni equivalent, Md 30 and the like were variously proposed. On the contrary, the investigation on Mn—Cr based stainless steel has scarcely been made likewise δ cal.

The inventors have empirically investigated the easiness of forming strain-induced martensite phase in Mn—Cr based stainless steel and added modifications to the relation of Ni equivalent in the Ni—Cr based stainless steel to provide the following equation (2). This value of Ni equivalent shows a relation between stability of austenite phase (difficulty of strain-induced martensite transformation) and chemical composition in the Mn—Cr based stainless steel. The larger the value becomes, the more difficult the formation of strain-induced martensite is.

$$\text{Ni equivalent (mass \%)}=15C+0.33Si+0.71Mn+Ni+0.44Cr+0.60Mo+0.51Cu+21N+1.2V+0.8Ti+1.1Nb \quad (2)$$

wherein each elemental symbol in the above equation represents a content of respective element (mass %).

Figure 2:
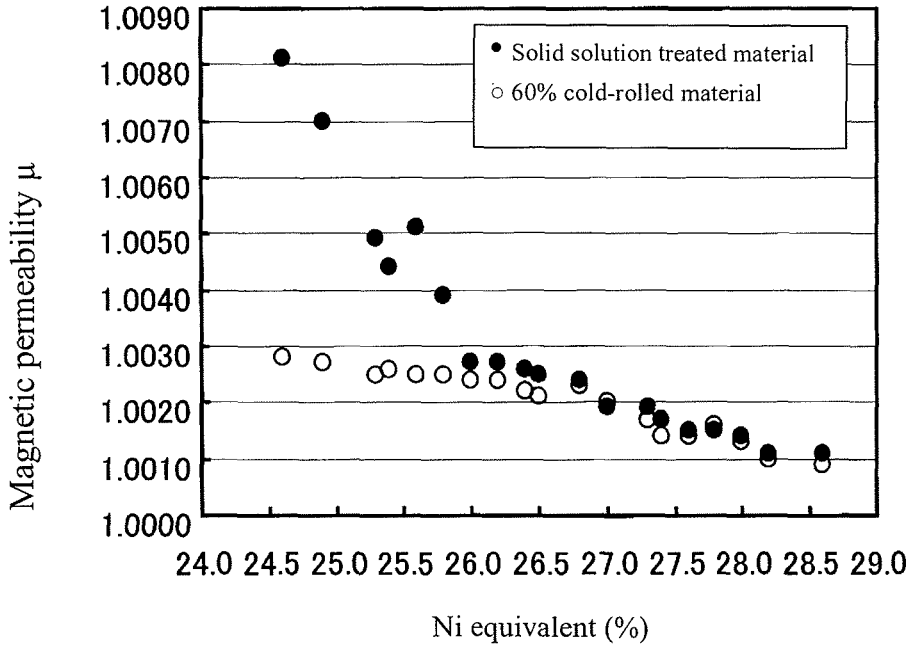
FIG. 2 is a graph showing an influence of Ni equivalent upon magnetic permeability of solid solution heat treated materials and cold rolled materials.

The inventors have investigated magnetic permeabilities in a magnetic filed of 200 kA/m of Mn—Cr based stainless steel sheets subjected to solution treatment with a largely varied Ni equivalent and materials formed by subjecting the steel sheets to cold rolling at a rolling reduction of 60% on the assumption of severe plastic working, thereby providing results shown in FIG. 2. As seen from these results, even when the magnetic permeability of the solution-treated material is a good nonmagnetic level of not more than 1.003, materials having a small stability of austenite phase with Ni equivalent of less than 26 mass % induce martensite phase through working and hence the magnetic permeability rises. The resulting martensite phase is trace, but brings about false detection through a needle detecting device, so that it is unfavorable as a material for clothing ornament. According to the invention, therefore, in order to ensure the nonmagnetic property even after the working, it is preferred to limit the Ni equivalent represented by the equation (2) to not more than 26 mass %.

(3) Influence of Mn on Magnetic Permeability

In the Ni—Cr based austenitic stainless steel, Mn is an element stabilizing austenite phase. Therefore, cheap stainless steels such as 200 series stainless steel and so on are manufactured by replacing Ni in SUS 304 with Mn as an alternative of expensive Ni. Thus, it is considered in the Ni—Cr based stainless steel that behaviors of Mn and Ni are substantially the same.

In the invention, however, it has been confirmed that as the addition amount of Mn increases, the behavior is not the same as in Ni and acts as an element stabilizing ferrite phase. Because, as seen from the above equation (1) of δ cal, when the Mn amount exceeds a certain level, δ-ferrite phase becomes increased and hence the nonmagnetic property is deteriorated.

Figure 3:
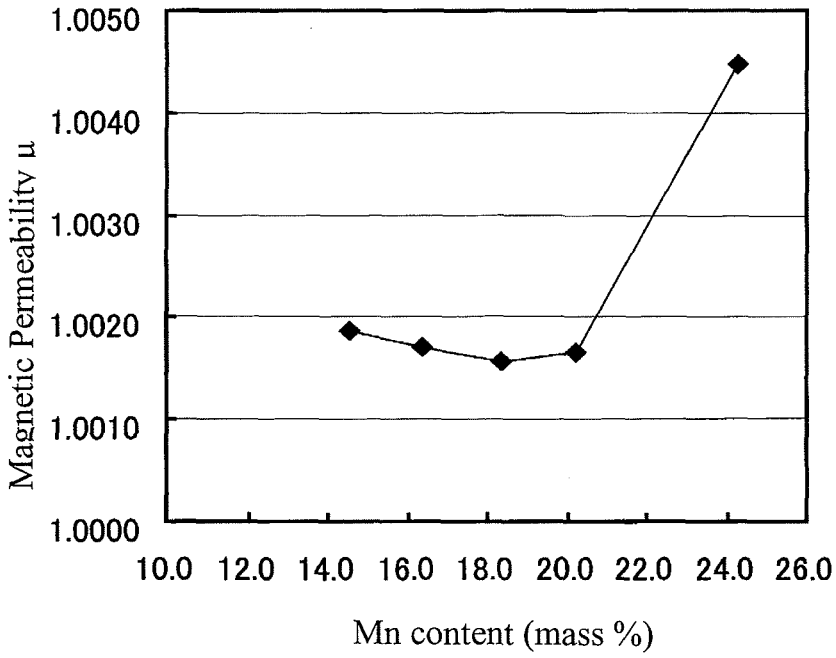
FIG. 3 is a graph showing an influence of Mn content upon magnetic permeability.

Now, the inventors have minutely investigated the influence of Mn content upon the magnetic permeability in steels of preventing the formation of δ-ferrite phase by adding predetermined amounts of C, N, Ni and the like and obtained results shown in FIG. 3. As seen from FIG. 3, the effect of reducing the magnetic permeability is confirmed in a region that the addition amount of Mn exceeds 10 mass %. However, the amount recognizing the effect of reducing the magnetic permeability is up to about 18 mass %, and if the addition amount exceeds this value, the action as a ferrite stabilizing element becomes large and hence a trace amount of δ-ferrite phase is retained to raise the magnetic permeability. When the addition amount of Mn is 25 mass %, the magnetic permeability largely exceeds 1.003. In the invention, therefore, the upper limit of the Mn amount is limited to 22 mass %. In the conventional knowledge for the Ni—Cr based stainless steel, the effect of suppressing the rise of magnetic permeability by Mn is a phenomenon confirmed only in the range of not more than 10 mass % (see JP-A-H08-269639).

(4) Improvement of Plastic Workability

In the conventional metal parts for clothing ornament brass, aluminum alloy and so on are used, so that equipments for manufacturing them are also designed assuming the strength of the brass or aluminum alloy. However, since the strength of the stainless steel is higher than those of the brass and aluminum alloy, poor working is caused if it is intended to manufacture the metal parts for clothing ornament using the stainless steel with the conventional equipments. Therefore, it is required to conduct softening in order to replace the brass or aluminum alloy with the stainless steel. Also, the aforementioned nonmagnetic stainless steels are harder than general-purpose stainless steel such as SUS 316L or the like, so that it is more required to conduct softening.

The inventors have empirically investigated a relation between hardness and steel components in the Mn—Cr based stainless steel subjected to solution treatment and obtained the following equation (3) through multiple regression analysis:

$$\text{Hv value}=87C+2Si-1.2Mn-6.7Ni+2.7Cr+3.2Mo-2.6Cu+690N+18V+20Ti+24NB+88 \quad (3)$$

wherein each elemental symbol in the above equation represents a content of respective element (mass %).

Figure 4:
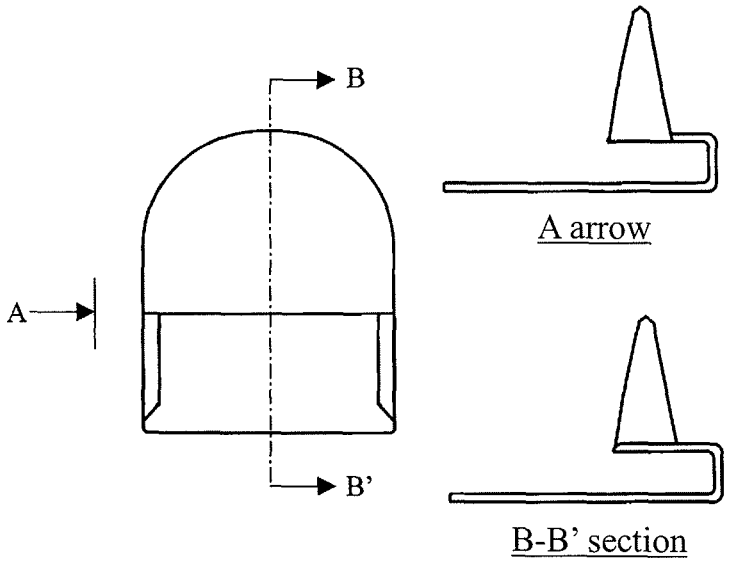
FIG. 4 is a schematic view of a clothing part (pant hooks and eyes) used in the evaluation of plastic workability.
Figure 5:
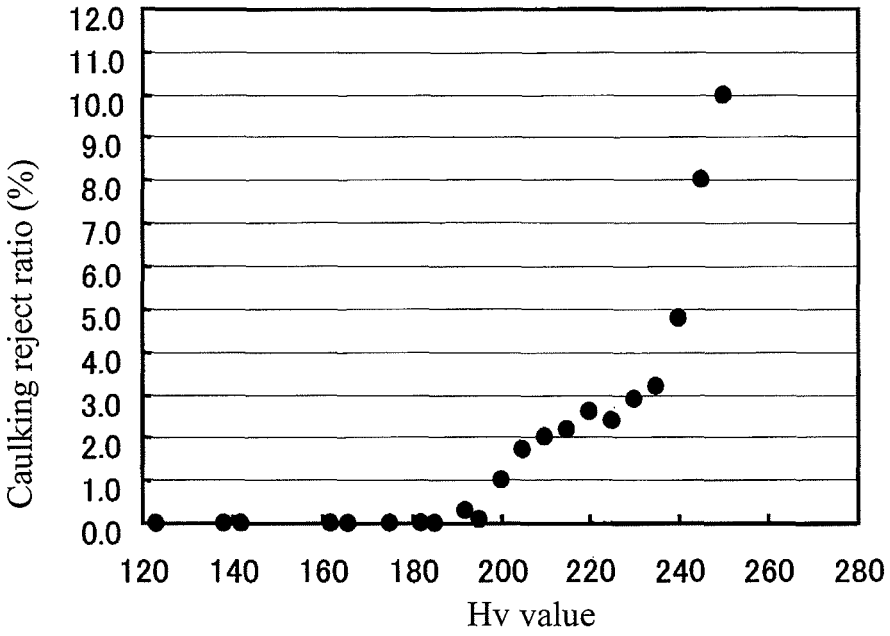
FIG. 5 is a graph showing an influence of hardness Hv upon caulking reject rate.

Now, parts for clothing ornament (pant hooks and eyes) as shown in FIG. 4 are manufactured with an actual manufacturing equipment using Mn—Cr based stainless steels having various different Hv values subjected to the solution treatment, which are attached to a fabric with the same caulking device as in the conventional one to investigate reject rate. The term "reject" used herein means that when protrusions on both sides of the pant hook shown in FIG. 4 are folded inward and attached to the fabric, the caulking is insufficient to generate a gap between the fabric and the caulked protrusion. FIG. 5 shows a relation between Hv value and reject rate, from which it can be seen that the Hv value should be not more than 200 in case that the reject rate is not more than 1%, and not more than 185 in case that the reject rate is zero.

In the invention, therefore, it is preferable that the Hv value represented by the equation (3) is limited to not more than 200.

The composition range of each component in the Mn—Cr based stainless steel according to the invention will be described below.

C: 0.02-0.12 mass %

C is an austenite forming element and is effective for preventing the formation of δ-ferrite phase produced at a higher temperature but also suppressing the formation of strain-induced martensite phase in plastic working. In order to obtain this effect, C is necessary to be included in an amount of at least 0.02 mass %. On the other hand, the excessive addition of C enhances the hardness after the heat treatment and lower the workability, and also carbide may be retained depending on the heat treating conditions to bring about the deterioration of corrosion resistance. Therefore, it is not more than 0.12 mass %. Preferably, it is a range of 0.03-0.11 mass %.

Si: 0.05-1.5 mass %

Si is an element added as a deoxidizer. In order to obtain this effect, it is necessary to be added in an amount of at least 0.05 mass %. On the other hand, Si is a ferrite forming element, so that the addition exceeding 1.5 mass % promotes the formation of S-ferrite phase and enhances the hardness after the heat treatment. Therefore, Si is added within a range of 0.05-1.5 mass %. Preferably, it is a range of 0.1-1.3 mass %.

Mn: 10.0-22.0 mass %

Mn is an element effective for reducing the magnetic permeability of austenitic stainless steel and has an effect of increasing solid-soluted amount of N for reducing the magnetic permeability, so that it contributes directly or indirectly to effectively reduce the magnetic permeability. It is an essential and important element in the stainless steel of the invention. In addition, Mn has an effect of softening steel and improving the plastic workability. In order to obtain theses effects, it is necessary to be added in an amount of at least 10.0 mass %. On the other hand, the addition exceeding 22.0 mass % deteriorate the nonmagnetic properties. In the invention, therefore, Mn is added within a range of 10.0-22.0 mass %. Preferably, it is a range of 12.0-20.0 mass %.

S: not more than 0.03 mass %

S is an impurity incorporated from a scrap as a steelmaking material and is a harmful element deteriorating hot workability, so that it is desirable to reduce it as much as possible. In the invention, therefore, S is limited to not more than 0.03 mass %. Preferably, it is not more than 0.02 mass %.

Ni: 4.0-12.0 mass %

Ni is an austenite forming element and indicates substantially the same behavior as in C and N on the structure stability of austenite phase. Also, Ni promotes the softening and is an element required from a viewpoint of ensuring the plastic workability. In order to obtain these effects, it is necessary to be added in an amount of at least 4.0 mass %. While, when the amount exceeding 12.0 mass % is added, the above effects are saturated and only the rise of material cost is caused. Therefore, Ni is added within a range of 4.0-12.0 mass %. Preferably, it is a range of 4.5-11.0 mass %.

Cr: 14.0-25.0 mass %

Cr is an element required for ensuring corrosion resistance of steel and preventing discoloration. In order to obtain this effect, it is necessary to be added in an amount of at least 14.0 mass %. On the other hand, since Cr is a ferrite forming element, the addition exceeding 25.0 mass % promotes the formation of δ-ferrite phase and considerably deteriorate the nonmagnetic property. Therefore, Cr is added within a range of 14.0-25.0 mass %. Preferably, it is a range of 15.0-20.0 mass %.

N: 0.07-0.17 mass %

N is an austenite forming element and an element suppressing the formation of δ-ferrite phase or strain-induced martensite phase and an important element for obtaining excellent nonmagnetic properties. In order to obtain these effects, it is necessary to be added in an amount of at least 0.07 mass %. On the other hand, N is also an element deteriorating the plastic workability because the hardness is considerably increased by solid-solution strengthening. Therefore, N is a range of 0.07-0.17 mass %. Preferably, it is a range of 0.08-0.16 mass %.

The high-Mn austenitic stainless steel according to the invention can further contain one or more selected from Mo, Cu, V, Ti and Nb: 0.02-1.0 mass % with in the following range in addition to the above essential components.

Cu: 0.03-3.0 mass %

Cu is an element reducing the hardness after the heat treatment, enhancing the stability of austenite phase and contributing to the structure stability. In order to develop these effects, it is necessary to be added in an amount of at least 0.03 mass %. On the other hand, the addition exceeding 3.0 mass % deteriorates the hot workability. In case of adding Cu, therefore, it is preferably added within a range of 0.03-3.0 mass %. More preferably, it is a range of 0.05-2.5 mass %.

Mo: 0.03-2.0 mass %

Mo is an element considerably improving the corrosion resistance at a small addition amount. In order to develop this effect, it is necessary to be added in an amount of at least 0.03 mass %. On the other hand, since Mo is a ferrite forming element, the addition exceeding 2.0 mass % promotes the formation of δ-ferrite phase and considerably deteriorate the nonmagnetic properties. In case of adding Mo, therefore, it is preferably within a range of 0.03-2.0 mass %. More preferably, it is a range of 0.05-1.8 mass %.

V: 0.02-1.0 mass %, Ti: 0.02-1.0 mass %, Nb: 0.02-1.0 mass %

V, Ti and Nb form a fine carbide during the heat treatment, and suppress the growth of crystal particles and finely divide them to make surface quality smooth after the shaping of the part and contribute effectively to improve the designability and grinding property. In order to obtain these effects, each of them is necessary to be added in an amount of at least 0.02 mass %. However, the addition exceeding 1.0 mass % increases the hardness and damages the workability. In case of adding these elements, therefore, each of them is preferably added within a range of 0.02-1.0 mass %. More preferably, it is a range of 0.03-0.8 mass %.

Moreover, the high-Mn austenitic stainless steel according to the invention may further contain one or more selected from B, Ca, REM and Mg within the following range in addition to the above components.

B: 0.0005-0.01 mass %, Ca: 0.0005-0.01 mass %, REM: 0.0005-0.01 mass %, Mg: 0.0005-0.01 mass %

B, Ca, REM and Mg can be added for improving the deterioration of hot workability through S. In order to obtain this effect, each of them is necessary to be added in an amount of at least 0.0005 mass %. However, the addition of these elements respectively exceeding 0.01 mass % rather forms a low melting point compound and deteriorates the hot workability. Therefore, each of these elements is preferably added within a range of 0.0005-0.01 mass %. More preferably it is a range of 0.0008-0.008 mass %.

The austenitic stainless steel according to the invention is necessary to contain the above components so that the value of δ cal represented by the following equation (1):

$$\delta\ \text{cal (mass \%)}=(\text{Cr}+0.48\text{Si}+1.2\text{Mo}+2.2(\text{V}+\text{Ti})+0.15\text{Nb})-(\text{Ni}+0.47\text{Cu}+0.11\text{Mn}-0.0101\text{Mn}^2+26.4\text{C}+20.1\text{N})-4.7 \quad (1)$$

(wherein each elemental symbol in the above equation represents a content of respective element (mass %)) is not more than 5.5 mass % in addition to the fact that each of the components satisfies the above composition range.

The δ cal shows a relation between δ-ferrite phase ratio and steel components in a slab when the slab is produced through a continuous casting process as previously mentioned and is an indicator effective for reducing a residual ratio of δ-ferrite phase in a product. When the value of δ cal exceeds 5.5 mass %, δ-ferrite phase remains even after the hot rolling or after the cold rolling, and hence the nonmagnetic properties are considerably deteriorated. In the invention, therefore, the value of δ cal is limited to not more than 5.5 mass %. Preferably, it is not more than 4.5 mass %.

In the high-Mn austenitic stainless steel according to the invention, it is preferable that the above components are included so that Ni equivalent represented by the following equation (2):

$$\text{Ni equivalent (mass \%)}=15C+0.33Si+0.71Mn+Ni+0.44Cr+0.60Mo+0.51Cu+21N+1.2V+0.8Ti+1.1Nb \quad (2)$$

(wherein each elemental symbol in the above equation represents a content of respective element (mass %)) is not less than 26 mass %.

As mentioned above, the Ni equivalent is an indicator showing a relation between stability of austenite phase and steel components in the Mn—Cr based stainless steel or an indicator showing the contribution degree of each alloying element to the stability of austenite phase. In order to ensure the nonmagnetic properties, it is required to prevent the formation of strain-induced martensite phase through plastic working. When the Ni equivalent is less than 26 mass %, it is easy to form the strain-induced martensite phase through the plastic working and the nonmagnetic properties are deteriorated. In the invention, therefore, the Ni equivalent is preferably limited to not less than 26 mass %. More preferably, it is not less than 27 mass %.

In the high-Mn austenitic stainless steel according to the invention, it is further preferable that the above components are included so that the Hv value represented by the following equation (3):

$$\text{Hv value}=87C+2Si-1.2Mn-6.7Ni+2.7Cr+3.2Mo-2.6Cu+690N+18V+20Ti+24NB+88 \quad (3)$$

(wherein each elemental symbol in the above equation represents a content of respective element (mass %)) is not more than 200.

In order to ensure good plastic workability and caulking workability, it is necessary to be soft. The above Hv value is an indicator showing a relation between hardness and chemical composition of the solution-treated Mn—Cr based stainless steel. When the Hv value exceeds 200, the rejection rate in the plastic working becomes higher. In the invention, therefore, the Hv value is preferably limited to not more than 200. More preferably, it is not more than 185.

EXAMPLES

Stainless steels of Nos. 1-26 having a chemical composition shown in Table 1 are prepared by the usual process and continuously cast into a slab of 150 mm in thickness×1000 mm in width×6000 mm in length. As a reference material, slabs of SUS 305, SUS 316L and SUS 310S are also respectively produced. These slabs are re-heated and hot-rolled at 1000-1300° C. to form a hot rolled material of 6 mm in thickness (coil), and thereafter the hot rolled material is annealed, pickled and cold-rolled to form a cold rolled material of 2.0 mm in thickness (rolling reduction of 67%), which is further annealed at a temperature of 1000-1200° C. and then pickled to obtain a cold rolled and annealed material. Also, a part of the cold rolled and annealed material is subjected to a secondary cold rolling to form a cold rolled material of 0.7 mm in thickness (rolling reduction of 65%), which is annealed at a temperature of 1000-1200° C. and pickled to obtain a secondary cold rolled and annealed material. These cold rolled, annealed materials and the secondary cold rolled, annealed materials are subjected to the following tests for evaluation.

TABLE 1

| Steel | Chemical Composition (mass %) | | | | | | | | | | | | |
|---|---|---|---|---|---|---|---|---|---|---|---|---|---|
| No. | C | Si | Mn | S | Ni | Cr | N | Mo | Cu | V | Ti | Nb | B |
| 1 | 0.117 | 0.52 | 10.09 | 0.0005 | 5.21 | 19.42 | 0.134 | — | — | — | — | — | — |
| 2 | 0.069 | 0.22 | 16.89 | 0.0017 | 4.61 | 16.51 | 0.136 | — | — | — | — | — | — |
| 3 | 0.064 | 0.39 | 16.48 | 0.0001 | 7.44 | 17.21 | 0.125 | — | — | — | — | — | — |
| 4 | 0.033 | 1.26 | 19.71 | 0.0006 | 8.82 | 15.23 | 0.099 | — | — | — | — | — | — |
| 5 | 0.105 | 0.12 | 13.61 | 0.0012 | 6.22 | 19.58 | 0.147 | — | — | — | — | — | — |
| 6 | 0.092 | 0.79 | 12.23 | 0.0019 | 10.71 | 19.88 | 0.082 | — | — | — | — | — | — |
| 7 | 0.025 | 1.44 | 21.69 | 0.0008 | 11.82 | 14.21 | 0.163 | — | — | — | — | — | — |
| 8 | 0.108 | 0.08 | 12.61 | 0.0011 | 4.18 | 19.35 | 0.132 | — | — | — | — | — | — |
| 9 | 0.078 | 1.03 | 14.75 | 0.0007 | 11.32 | 23.33 | 0.072 | — | — | — | — | — | — |
| 10 | 0.099 | 0.71 | 16.55 | 0.0002 | 8.94 | 15.63 | 0.111 | 1.77 | — | — | — | — | — |
| 11 | 0.048 | 0.98 | 15.06 | 0.0006 | 6.21 | 20.14 | 0.138 | — | 2.44 | — | — | — | — |
| 12 | 0.058 | 0.49 | 17.55 | 0.0012 | 7.99 | 18.88 | 0.156 | 0.40 | — | 0.51 | — | — | — |
| 13 | 0.071 | 0.55 | 16.88 | 0.0004 | 7.81 | 16.93 | 0.108 | 1.91 | — | — | 0.44 | 0.09 | — |
| 14 | 0.059 | 1.05 | 20.05 | 0.0006 | 10.81 | 21.51 | 0.153 | — | 0.07 | 0.49 | 0.21 | 0.18 | — |
| 15 | 0.065 | 0.41 | 18.01 | 0.0025 | 7.22 | 16.99 | 0.141 | 0.08 | — | — | — | — | 0.0020 |
| 16 | 0.051 | 0.65 | 18.43 | 0.0024 | 8.42 | 22.02 | 0.133 | — | 2.88 | — | — | — | — |
| 17 | 0.092 | 0.88 | 10.32 | 0.0028 | 6.92 | 18.15 | 0.091 | — | — | — | — | — | 0.0030 |
| 18 | 0.072 | 0.44 | 9.48 | 0.0005 | 7.58 | 17.06 | 0.143 | — | — | — | — | — | — |
| 19 | 0.068 | 0.67 | 23.01 | 0.0008 | 5.66 | 17.89 | 0.129 | — | — | — | — | — | — |
| 20 | 0.031 | 1.17 | 15.22 | 0.0005 | 3.28 | 16.59 | 0.158 | — | — | — | — | — | — |
| 21 | 0.089 | 0.89 | 17.92 | 0.0012 | 7.02 | 18.77 | 0.061 | — | — | — | — | — | — |
| 22 | 0.081 | 0.65 | 19.67 | 0.0011 | 6.55 | 18.02 | 0.182 | — | — | — | — | — | — |
| 23 | 0.101 | 1.42 | 18.11 | 0.0035 | 6.77 | 18.83 | 0.141 | — | 0.51 | 0.08 | — | — | — |
| 24 | 0.059 | 0.61 | 18.58 | 0.0018 | 4.89 | 19.58 | 0.115 | — | — | — | — | — | — |
| 25 | 0.049 | 0.22 | 14.49 | 0.0007 | 4.31 | 16.51 | 0.106 | — | — | — | — | — | — |
| 26 | 0.031 | 1.17 | 15.22 | 0.0007 | 4.11 | 16.59 | 0.168 | — | — | — | — | — | — |
| 27 | 0.057 | 0.51 | 1.21 | 0.0006 | 12.45 | 18.04 | 0.036 | — | — | — | — | — | — |
| 28 | 0.026 | 0.45 | 0.98 | 0.0026 | 12.99 | 17.55 | 0.051 | 2.56 | — | — | — | — | — |
| 29 | 0.055 | 0.35 | 0.88 | 0.0029 | 20.15 | 25.09 | 0.039 | — | — | — | — | — | — |

TABLE 1-continued

| Steel No. | Chemical Composition (mass %) Ca | REM | Mg | δ cal (mass %) | Ni equivalent (mass %) | Hv value | Remarks |
|---|---|---|---|---|---|---|---|
| 1 | — | — | — | 3.9 | 26 | 197 | Invention Ex. |
| 2 | — | — | — | 3.8 | 28 | 182 | Invention Ex. |
| 3 | — | — | — | 2.0 | 30 | 157 | Invention Ex |
| 4 | — | — | — | 1.2 | 33 | 120 | Invention Ex |
| 5 | — | — | — | 3.4 | 29 | 194 | Invention Ex |
| 6 | — | — | — | 0.9 | 32 | 121 | Invention Ex |
| 7 | — | — | — | −3.2 | 37 | 139 | Invention Ex |
| 8 | — | — | — | 5.2 | 26 | 198 | Invention Ex |
| 9 | — | — | — | 4.9 | 35 | 116 | Invention Ex |
| 10 | — | — | — | 0.6 | 32 | 143 | Invention Ex |
| 11 | — | — | — | 5.1 | 31 | 178 | Invention Ex |
| 12 | — | — | — | 4.5 | 34 | 189 | Invention Ex. |
| 13 | — | — | — | 5.0 | 32 | 160 | Invention Ex. |
| 14 | — | — | — | 5.3 | 40 | 180 | Invention Ex. |
| 15 | — | — | — | 2.1 | 31 | 168 | Invention Ex. |
| 16 | 0.0015 | 0.0030 | — | 5.2 | 36 | 159 | Invention Ex. |
| 17 | 0.0015 | — | 0.0015 | 2.6 | 26 | 151 | Invention Ex. |
| 18 | — | — | | 0.1 | 26 | 178 | Comparative Ex. |
| 19 | — | — | — | 6.3 | 33 | 167 | Comparative Ex. |
| 20 | — | — | — | 5.8 | 25 | 207 | Comparative Ex. |
| 21 | — | — | — | 5.2 | 31 | 122 | Comparative Ex. |
| 22 | — | — | — | 3.0 | 33 | 203 | Comparative Ex. |
| 23 | 0.0020 | — | 0.0013 | 3.8 | 33 | 181 | Comparative Ex. |
| 24 | — | — | — | 7.9 | 30 | 172 | Comparative Ex. |
| 25 | — | — | — | 4.7 | 25 | 164 | Comparative Ex. |
| 26 | — | — | — | 4.8 | 26 | 208 | * |
| 27 | — | — | — | — | — | — | SUS305 |
| 28 | — | — | — | — | — | — | SUS316L |
| 29 | — | — | — | — | — | — | SUS310S |

δ cal (mass %) = (Cr + 0.48Si + 1.21Mo + 2.2(V + Ti)+ 0.15Nb) − (Ni + 0.47Cu + 0.11Mn − 0.0101Mn$^2$ + 26.4C + 20.1N) − 4.7
Ni equivalent (mass %) = 15C + 0.33Si + 0.71Mn + Ni + 0.44Cr + 0.60Mo + 0.51Cu + 21N + 1.2V + 0.8Ti + 1.1Nb
Hv value = 87C + 2Si − 1.2Mn − 6.7Ni + 2.7Cr + 3.2Mo − 2.6Cu + 690N + 18V + 20Ti + 24Nb + 88
* No. 26 is Invention Example corresponding to claims 1 and 2 but Comparative Example corresponding to claim 3.

<Measurement of Magnetic Permeability>

With respect to both of the cold rolled material of 2.0 mm in thickness as cold-rolled and the cold rolled, annealed material subjected to annealing, the magnetic permeability μ is measured by applying a magnetic field of 200 kA/m with an oscillation type magnetic measuring instrument (BHV-55 made by Riken Densi Co., Ltd.). Moreover, the evaluation of magnetic permeability indicates that the nonmagnetic property is good at a value of not more than 1.003.

<Observation of Microstructure>

The presence or absence of residual δ-ferrite phase is judged by polishing a surface of the cold rolled, annealed material of 2 mm in thickness at a section in the rolling direction, electrolytic etching with KOH to expose a crystal structure and observing its microstructure with an optical microscope.

<Evaluation of False Detection by Needle Detecting Device>

A metal part for clothing (pant hook and eyes) as shown in FIG. 4 is manufactured with the secondary cold rolled, annealed material of 0.7 mm in thickness. A plurality of the thus obtained metal parts are arranged on a conveyor of a needle detecting device utilizing magnetic induction (APA-6500 made by Sanko Co., Ltd.) in a direction perpendicular to the traveling direction and passed through the needle detecting device to determine a minimum number capable of being measured by the needle detecting device. In this case, the detection sensitivity of the device is set to a level capable of detecting an iron ball of 0.8 mm ϕ corresponding to a size of a fractured needle. In this evaluation test, the larger the minimum number becomes, the better the nonmagnetic property is, which means that the needle detecting device hardly causes the false detection.

<Measurement of Hardness>

A Vickers hardness Hv is measured on a surface of the cold rolled, annealed material of 2 mm in thickness.

<Evaluation of Plastic Workability>

A metal part for clothing (pant hook and eyes) as shown in FIG. 4 is manufactured with the secondary cold rolled, annealed material of 0.7 mm in thickness. The thus obtained metal parts are attached to a cloth by caulking every 1000 parts to measure a reject ratio. Moreover, the workability is evaluated by a reject ratio when the joining to the cloth without gap is acceptable and the generation of gap is not acceptable.

<Evaluation of Polishing Property>

It is evaluated by polishing a widest area of a metal part for clothing (pant hook and eyes) shown in FIG. 4, which is manufactured from the secondary cold rolled, annealed material of 0.7 mm in thickness, with a dry buffing polishing apparatus to measure a polishing time required from a pickled surface state to a #400 finished surface state. Moreover, the polishing property is evaluated by an average time required for a single steel subjected to polishing five times.

<Evaluation of Productivity>

After the hot rolled material (coil) after the hot rolling is annealed and pickled, a full length of the coil discharged from the pickling line is visually observed to measure the number of harmful defects generated on the surface such as sliver, scab and so on. In the evaluation as the number of defects per 100 m of the coil, not more than 0.5 is excellent productivity ("excellent"), and more than 0.5 but not more than 1.0 is good productivity ("good"), and more than 1.0 is poor productivity ("poor").

The results on the above evaluation tests are shown in Table 2.

As seen from Table 2, all the steel sheets Nos. 1-17 of Invention Examples satisfying the conditions of the invention are small in the magnetic permeability and excellent in the nonmagnetic property. Also, they are low in the hardness, good in the workability after the caulking and suitable as a material for clothing parts. Among them, the steel sheets Nos. 12-14 added with the appropriate amount of one or more of V, Ti and Nb are excellent in not only the workability and nonmagnetic property but also the polishing property, and contribute to improve the operability. On the other hand, the steel sheets Nos. 15-17 added with the appropriate amount of one or more of B, Ca, REM and Mg are good in the surface quality and excellent in the productivity.

On the contrary, the steel sheets Nos. 18-29 of Comparative Examples and Reference Examples not satisfying the conditions of the invention are poor in one or more of the nonmagnetic property, plastic workability and productivity. For example, the steel sheets Nos. 18 and 21 can prevent the residual δ-ferrite phase and the formation of strain-induced martensite phase because they satisfy standard values of δ cal of the equation (1) and Ni equivalent of the equation (2), but do not reach the target level of the magnetic permeability (not more than 1.003) because the Mn and N contents for improving the nonmagnetic property are less.

In the steel sheet No. 19 having Mn content and δ cal larger than those of the invention and the steel sheet No. 20 having Ni equivalent smaller than that of the invention, the magnetic permeability of the annealed material becomes large because there is the residual δ-ferrite phase. In the steel sheet No. 20, the Ni equivalent is low and the stability of austenite phase is small, so that the strain-induced martensite phase is formed and the magnetic permeability of the cold rolled material is high.

The steel sheet No. 22 having N content larger than that of the invention is good in the nonmagnetic property but is high in the hardness and becomes high in the caulking reject ratio.

In the steel sheet No. 23, the nonmagnetic property is good, but since the S content is outside of the range of the invention, even if Ca and Mg are added, the effect of improving the hot workability is not sufficient and many surface defects are caused.

In the steel sheet No. 24, the vale of δ cal is outside of the range of the invention, so that δ-ferrite remains in the product and the magnetic permeability does not reach the target level.

In the steel sheet No. 25 wherein the Ni equivalent of the equation (2) does not satisfy the preferred range of the invention, the strain-induced martensite is formed by cold rolling and the magnetic permeability becomes large. In the steel sheet No. 26 wherein the By value of the equation (3) does not satisfy the preferred range of the invention, the nonmagnetic property is good, but the hardness is high and the workability is poor.

In all SUS 305, SUS 316L and SUS 310S of Ni—Cr based nonmagnetic stainless steel evaluated as Reference Examples, the nonmagnetic property and productivity are poor as compared with the Mn—Cr based nonmagnetic stainless steel according to the invention.

TABLE 2

| | Magnetic permeability | | Nonmagnetic properties | | Plastic workability | | Average | | |
|---|---|---|---|---|---|---|---|---|---|
| Steel No. | Annealed material | Cold rolled material | Residual δ-ferrite | Number detected by needle detecting device | Hardness Hv | Caulking reject ratio | polishing time (sec) | Evaluation of productivity | Remarks |
| 1 | 1.0025 | 1.0027 | none | 4 | 192 | 0.9 | 76 | Good | Invention Ex. |
| 2 | 1.0021 | 1.0024 | none | 5 | 188 | 0.1 | 75 | Good | Invention Ex. |
| 3 | 1.0018 | 1.0021 | none | 5 | 165 | 0.0 | 71 | Good | Invention Ex. |
| 4 | 1.0019 | 1.0021 | none | 5 | 128 | 0.0 | 72 | Good | Invention Ex. |
| 5 | 1.0020 | 1.0022 | none | 5 | 196 | 0.3 | 71 | Good | Invention Ex. |
| 6 | 1.0019 | 1.0020 | none | 5 | 130 | 0.0 | 73 | Good | Invention Ex. |
| 7 | 1.0022 | 1.0025 | none | 5 | 134 | 0.0 | 88 | Good | Invention Ex. |
| 8 | 1.0024 | 1.0025 | none | 4 | 196 | 0.8 | 83 | Good | Invention Ex. |
| 9 | 1.0023 | 1.0025 | none | 5 | 125 | 0.0 | 76 | Good | Invention Ex. |
| 10 | 1.0025 | 1.0026 | none | 4 | 145 | 0.0 | 75 | Good | Invention Ex. |
| 11 | 1.0025 | 1.0027 | none | 4 | 178 | 0.0 | 78 | Good | Invention Ex. |
| 12 | 1.0023 | 1.0025 | none | 5 | 187 | 0.4 | 36 | Good | Invention Ex. |
| 13 | 1.0024 | 1.0025 | none | 4 | 167 | 0.0 | 35 | Good | Invention Ex. |
| 14 | 1.0021 | 1.0022 | none | 5 | 183 | 0.0 | 38 | Good | Invention Ex. |
| 15 | 1.0019 | 1.0021 | none | 5 | 171 | 0.0 | 73 | Excellent | Invention Ex. |
| 16 | 1.0023 | 1.0025 | none | 4 | 156 | 0.0 | 81 | Excellent | Invention Ex. |
| 17 | 1.0020 | 1.0023 | none | 5 | 157 | 0.0 | 77 | Excellent | Invention Ex. |
| 18 | 1.0038 | 1.0041 | none | 2 | 195 | 0.5 | 77 | Good | Comparative Ex. |
| 19 | 1.0064 | 1.0066 | presence | 0 | 154 | 0.0 | 83 | Good | Comparative Ex. |
| 20 | 1.0058 | 1.0072 | presence | 0 | 215 | 5.2 | 75 | Good | Comparative Ex. |
| 21 | 1.0040 | 1.0044 | none | 1 | 134 | 0.0 | 75 | Good | Comparative Ex. |
| 22 | 1.0019 | 1.0020 | none | 5 | 207 | 4.1 | 76 | Good | Comparative Ex. |
| 23 | 1.0021 | 1.0022 | none | 4 | 181 | 0.2 | 38 | Poor | Comparative Ex. |
| 24 | 1.0056 | 1.0057 | presence | 0 | 165 | 0.0 | 77 | Good | Comparative Ex. |
| 25 | 1.0026 | 1.0061 | none | 0 | 168 | 0.0 | 88 | Good | Comparative Ex. |
| 26 | 1.0023 | 1.0026 | none | 4 | 211 | 3.8 | 92 | Good | * |
| 27 | 1.0032 | 1.0036 | none | 2 | 172 | 0.1 | 79 | Good | SUS 305 |
| 28 | 1.0040 | 1.0048 | none | 1 | 167 | 0.0 | 76 | Good | SUS 316L |
| 29 | 1.0045 | 1.0051 | none | 0 | 181 | 0.3 | 89 | Poor | SUS 310S |

* No. 26 is Invention Example corresponding to claims 1 and 2 but Comparative Example corresponding to claim 3.

INDUSTRIAL APPLICABILITY

The stainless steels according to the invention are not limited to an application as a starting material of metal parts for clothing, and can be preferably used in the other fields requiring the plastic workability and nonmagnetic property, for example, in the filed of electronic parts such as mobile phones, portable digital media players and so on.

The invention claimed is:

1. A clothing ornament made from a high-Mn austenitic stainless steel having a chemical composition comprising C: 0.02-0.12 mass %, Si: 0.05-1.5 mass %, Mn: 12.00-18.43 mass %, S: not more than 0.03 mass %, Ni: 4.0-8.42 mass %, Cr: 14.0-25.0 Mass %, N: 0.07-0.17 mass % and Cu: 0.03-3.0 mass %, and optionally one or more elements selected from Mo, V, Ti and Nb, with the balance being Fe and inevitable impurities, provided that these components are contained so that δ cal represented by the following equation (1) is not more than 5.5%:

$$\delta\ \text{cal (mass \%)}=(\text{Cr}+0.48\text{Si}+1.21\text{Mo}+2.2(\text{V}+\text{Ti})+0.15\text{Nb})-(\text{Ni}+0.47\text{Cu}+0.11\text{Mn}-0.0101\text{Mn}^2+26.4\text{C}+20.1\text{N})-4.7 \quad (1)$$

wherein each element symbol in the equation is a content of the respective element (mass %), and having a magnetic permeability of not more than 1.003 under a magnetic field of 200 kA/m.

2. A clothing ornament made from a high-Mn austenitic stainless steel according to claim 1, which further contains one or more elements selected from Mo in an amount of 0.03-2.0 mass %, V in an amount of 0.02-1.0 mass %, Ti in an amount of 0.02-1.0 mass % and Nb in an amount of 0.02-1.0 mass %.

3. A clothing ornament made from a high-Mn austenitic stainless steel according to claim 1, which further contains one or more elements selected from B: 0.0005-0.01 mass %, Ca: 0.0005-0.01 mass %, REM: 0.0005-0.01 mass % and Mg: 0.0005-0.01 mass % in addition to the above chemical composition.

4. A clothing ornament made from a high-Mn austenitic stainless steel according to claim 2, which further contains one or more elements selected from B: 0.0005-0.01 mass %, Ca: 0.0005-0.01 mass %, REM: 0.0005-0.01 mass % and Mg: 0.0005-0.01 mass % in addition to the above chemical composition.

5. A clothing ornament made from a high-Mn austenitic stainless steel according to claim 1, wherein said components are contained so that Ni equivalent represented by the following equation (2) is not less than 26 mass %:

$$\text{Ni equivalent (mass \%)}=15\text{C}+0.33\text{Si}+0.71\text{Mn}+\text{Ni}+0.44\text{Cr}+0.60\text{Mo}+0.51\text{Cu}+21\text{N}+1.2\text{V}+0.8\text{Ti}+1.1\text{Nb} \quad (2)$$

wherein each element symbol in the equation is a content of the respective element (mass %).

6. A metal part for clothing ornament made from a high-Mn austenitic stainless steel according to claim 2, wherein said components are contained so that Ni equivalent represented by the following equation (2) is not less than 26 mass %:

$$\text{Ni equivalent (mass \%)}=15\text{C}+0.33\text{Si}+0.71\text{Mn}+\text{Ni}+0.44\text{Cr}+0.60\text{Mo}+0.51\text{Cu}+21\text{N}+1.2\text{V}+0.8\text{Ti}+1.1\text{Nb} \quad (2)$$

wherein each element symbol in the equation is a content of the respective element (mass %).

7. A clothing ornament made from a high-Mn austenitic stainless steel according to claim 3, wherein said components are contained so that Ni equivalent represented by the following equation (2) is not less than 26 mass %:

$$\text{Ni equivalent (mass \%)}=15\text{C}+0.33\text{Si}+0.71\text{Mn}+\text{Ni}+0.44\text{Cr}+0.60\text{Mo}+0.51\text{Cu}+21\text{N}+1.2\text{V}+0.8\text{Ti}+1.1\text{Nb} \quad (2)$$

wherein each element symbol in the equation is a content of the respective element (mass %).

8. A clothing ornament made from a high-Mn austenitic stainless steel according to claim 4, wherein said components are contained so that Ni equivalent represented by the following equation (2) is not less than 26 mass %:

$$\text{Ni equivalent (mass \%)}=15\text{C}+0.33\text{Si}+0.71\text{Mn}+\text{Ni}+0.44\text{Cr}+0.60\text{Mo}+0.51\text{Cu}+21\text{N}+1.2\text{V}+0.8\text{Ti}+1.1\text{Nb} \quad (2)$$

wherein each element symbol in the equation is a content of the respective element (mass %).

9. A clothing ornament made from a high-Mn austenitic stainless steel according to claim 1, wherein said components are contained so that Hv value represented by the following equation (3) is not more than 200:

$$\text{Hv value}=87\text{C}+2\text{Si}-1.2\text{Mn}-6.7\text{Ni}+2.7\text{Cr}+3.2\text{Mo}-2.6\text{Cu}+690\text{N}+18\text{V}+20\text{Ti}+24\text{Nb}+88 \quad (3)$$

wherein each element symbol in the equation is a content of the respective element (mass %).

10. A metal part for clothing ornament made from a high-Mn austenitic stainless steel according to claim 2, wherein said components are contained so that Hv value represented by the following equation (3) is not more than 200:

$$\text{Hv value}=87\text{C}+2\text{Si}-1.2\text{Mn}-6.7\text{Ni}+2.7\text{Cr}+3.2\text{Mo}-2.6\text{Cu}+690\text{N}+18\text{V}+20\text{Ti}+24\text{Nb}+88 \quad (3)$$

wherein each element symbol in the equation is a content of the respective element (mass %).

11. A metal part for clothing ornament made from a high-Mn austenitic stainless steel according to claim 3, wherein said components are contained so that Hv value represented by the following equation (3) is not more than 200:

$$\text{Hv value}=87\text{C}+2\text{Si}-1.2\text{Mn}-6.7\text{Ni}+2.7\text{Cr}+3.2\text{Mo}-2.6\text{Cu}+690\text{N}+18\text{V}+20\text{Ti}+24\text{Nb}+88 \quad (3)$$

wherein each element symbol in the equation is a content of the respective element (mass %).

12. A clothing ornament made from a high-Mn austenitic stainless steel according to claim 4, wherein said components are contained so that Hy value represented by the following equation (3) is not more than 200:

$$\text{Hv value}=87\text{C}+2\text{Si}-1.2\text{Mn}-6.7\text{Ni}+2.7\text{Cr}+3.2\text{Mo}-2.6\text{Cu}+690\text{N}+18\text{V}+20\text{Ti}+24\text{Nb}+88 \quad (3)$$

wherein each element symbol in the equation is a content of the respective element (mass %).

13. A clothing ornament made from a high-Mn austenitic stainless steel according to claim 5, wherein said components are contained so that Hv value represented by the following equation (3) is not more than 200:

$$\text{Hv value}=87\text{C}+2\text{Si}-1.2\text{Mn}-6.7\text{Ni}+2.7\text{Cr}+3.2\text{Mo}-2.6\text{Cu}+690\text{N}+18\text{V}+20\text{Ti}+24\text{Nb}+88 \quad (3)$$

wherein each element symbol in the equation is a content of the respective element (mass %).

14. A clothing ornament made from a high-Mn austenitic stainless steel according to claim 6, wherein said components are contained so that Hv value represented by the following equation (3) is not more than 200:

$$\text{Hv value}=87\text{C}+2\text{Si}-1.2\text{Mn}-6.7\text{Ni}+2.7\text{Cr}+3.2\text{Mo}-2.6\text{Cu}+690\text{N}+18\text{V}+20\text{Ti}+24\text{Nb}+88 \quad (3)$$

wherein each element symbol in the equation is a content of the respective element (mass %).

15. A clothing ornament made from a high-Mn austenitic stainless steel according to claim 7, wherein said components are contained so that Hv value represented by the following equation (3) is not more than 200:

$$\text{Hv value}=87C+2Si-1.2Mn-6.7Ni+2.7Cr+3.2Mo-2.6Cu+690N+18V+20Ti+24Nb+88 \quad (3)$$

wherein each element symbol in the equation is a content of the respective element (mass %).

16. A clothing ornament made from a high-Mn austenitic stainless steel according to claim 8, wherein said components are contained so that Hv value represented by the following equation (3) is not more than 200:

$$\text{Hv value}=87C+2Si-1.2Mn-6.7Ni+2.7Cr+3.2Mo-2.6Cu+690N+18V+20Ti+24Nb+88 \quad (3)$$

wherein each element symbol in the equation is a content of the respective element (mass %).

* * * * *